US010490174B2

(12) United States Patent
Harada et al.

(10) Patent No.: US 10,490,174 B2
(45) Date of Patent: Nov. 26, 2019

(54) ELECTRONIC MUSICAL INSTRUMENT AND CONTROL METHOD

(71) Applicant: CASIO COMPUTER CO., LTD., Shibuya-ku, Tokyo (JP)

(72) Inventors: Eiichi Harada, Hamura (JP); Toshiya Kuno, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/141,036

(22) Filed: Sep. 25, 2018

(65) Prior Publication Data

US 2019/0096374 A1 Mar. 28, 2019

(30) Foreign Application Priority Data

Sep. 26, 2017 (JP) ..... 2017-184284

(51) Int. Cl.

| | |
|---|---|
| ***A63H 5/00*** | (2006.01) |
| ***G10H 5/00*** | (2006.01) |
| ***G10H 1/14*** | (2006.01) |
| ***G10H 1/00*** | (2006.01) |
| ***G10H 1/34*** | (2006.01) |
| ***G10H 1/055*** | (2006.01) |

(52) U.S. Cl.

CPC ..... *G10H 1/14* (2013.01); *G10H 1/0008* (2013.01); *G10H 1/0551* (2013.01); *G10H 1/34* (2013.01); *G10H 2210/225* (2013.01); *G10H 2210/251* (2013.01); *G10H 2220/161* (2013.01); *G10H 2220/361* (2013.01); *G10H 2230/221* (2013.01); *G10H 2230/365* (2013.01)

(58) Field of Classification Search

CPC ..... G10H 1/14; G10H 1/34; G10H 1/0008; G10H 2220/361; G10H 2230/365; G10H 2220/161

USPC ..... 84/649

See application file for complete search history.

(56) References Cited

U.S. PATENT DOCUMENTS

| | | | | |
|---|---|---|---|---|
| 6,653,546 | B2 * | 11/2003 | Jameson | G10H 3/125 84/616 |
| 7,390,959 | B2 * | 6/2008 | Masuda | G10H 1/053 84/662 |
| 8,796,529 | B2 * | 8/2014 | Butera | G10H 1/32 84/647 |

(Continued)

FOREIGN PATENT DOCUMENTS

JP H1185159 A 3/1999

*Primary Examiner* — Jeffrey Donels

(74) *Attorney, Agent, or Firm* — Holtz, Holtz & Volek PC

(57) ABSTRACT

An electronic musical instrument including a musical instrument body which is supported by first finger of a hand of an instrument player and at least one finger other than the first finger, scale keys which are provided at positions that are contacted with fingers other than the first finger on one surface of the musical instrument body, and each of which specifies a scale of a musical sound, a touchpad which is provided in an area that is contacted with the first finger on an other surface of the musical instrument body, and includes a sensor that has a planar detection area for detecting a contact position of the first finger, and a processor which controls emission of the musical sound whose scale has been specified by the scale key in accordance with the contact position of the first finger detected by the touchpad.

14 Claims, 13 Drawing Sheets

(56) References Cited

U.S. PATENT DOCUMENTS

| | | | | |
|---|---|---|---|---|
| 9,000,287 | B1 * | 4/2015 | Andersen | G10H 1/32<br>84/622 |
| 9,653,057 | B2 * | 5/2017 | Harada | G10H 1/46 |
| 2009/0049980 | A1 * | 2/2009 | Sharma | G10H 1/34<br>84/719 |
| 2013/0255474 | A1 * | 10/2013 | Hanks | G10H 1/342<br>84/615 |
| 2018/0350337 | A1 * | 12/2018 | Netherland | G10H 1/183 |

* cited by examiner

CROSS-SECTIONAL VIEW
TAKEN ALONG LINE III A - III A (INTERIOR SIDE OF MUSICAL INSTRUMENT BODY)

CROSS-SECTIONAL VIEW
TAKEN ALONG LINE III B - III B (INTERIOR SIDE OF MUSICAL INSTRUMENT BODY)

CROSS-SECTIONAL VIEW TAKEN ALONG LINE X B - X B

CONTACT AREA: LARGE
⇑ PRESSING FORCE AGAINST TOUCHPAD: LARGE

CONTACT AREA: SMALL
⇑ PRESSING FORCE AGAINST TOUCHPAD: SMALL

ELECTRONIC MUSICAL INSTRUMENT AND CONTROL METHOD

CROSS-REFERENCE TO RELATED APPLICATION

This application is based upon and claims the benefit of priority from the prior Japanese Patent Application No. 2017-184284, filed Sep. 26, 2017, the entire contents of which are incorporated herein by reference.

BACKGROUND OF THE INVENTION

1. Field of the Invention

The present invention relates to an electronic musical instrument having a form similar to that of acoustic wind instruments, and a control method including an operation method for the electronic musical instrument.

2. Description of the Related Art

Conventionally, electronic wind instruments are known which have a shape modeled after those of acoustic wind instruments such as saxophone and clarinet and use a musical performance method modeled thereafter. In a musical performance using such an electronic wind instrument, the pitch of a musical sound is specified by operating scale keys (or pitch keys) provided at respective key positions equivalent to those of acoustic wind instruments. The sound volume is controlled by the pressure (breath pressure) of a breath blown into a mouthpiece.

Also, in recent years, electronic wind instruments are known which are provided with devices such as special operation buttons and switches so as to achieve various musical performance methods, feelings of musical performance, and effects that are given to musical sounds (musical effects, such as a pitch bend to continuously change pitches and a vibrato to minutely vibrate pitches).

For example, Japanese Patent Application Laid-Open (Kokai) Publication No. 11-085159 discloses a technique in which, in order to achieve a pitch bend, a pitch bend wheel is provided on the back side of an electronic wind instrument, and rotationally operated during a musical performance so as to control the direction of pitch change in accordance with the direction of the operation (bending up, bending down).

SUMMARY OF THE INVENTION

In accordance with one aspect of the present invention, there is provided an electronic musical instrument, comprising: a musical instrument body which is supported by first finger of a hand of an instrument player and at least one finger other than the first finger; scale keys which are provided at positions that are contacted with fingers other than the first finger on one surface of the musical instrument body, and each of which specifies a scale of a musical sound; a touchpad which is provided in an area that is contacted with the first finger on an other surface of the musical instrument body, and includes a sensor that has a planar detection area for detecting a contact position of the first finger; and a processor which controls emission of the musical sound whose scale has been specified by the scale key in accordance with the contact position of the first finger detected by the touchpad.

In accordance with another aspect of the present invention, there is provided a control method for an electronic musical instrument having a musical instrument body which is supported by a first finger of a hand of an instrument player and at least one finger other than the first finger, comprising: determining a scale of a musical sound in accordance with an operation on scale keys provided at positions that are contacted with fingers other than the first finger on one surface of the musical instrument body; detecting a contact position of the first finger in accordance with an operation on a touchpad which is provided in an area that is contacted with the first finger on an other surface of the musical instrument body, and includes a sensor that has a planar detection area; and controlling emission of the musical sound whose scale has been determined in accordance with the detected contact position of the first finger.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Hereinafter, embodiments of an electronic musical instrument, a control method for the same, and a control program for the same according to the present invention are described in detail with reference to the drawings.

<First Embodiment>

(Electronic Musical Instrument)

Figure 1:
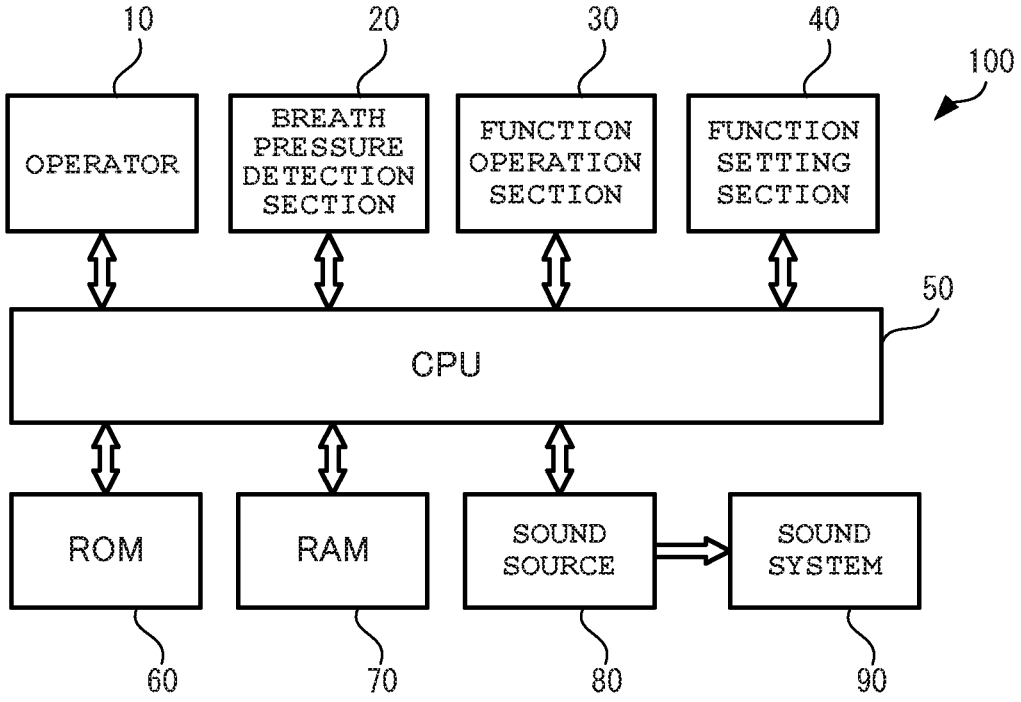
FIG. 1 is a block diagram showing an example of the functional structure of an electronic musical instrument according to the present invention.
Figure 2A:
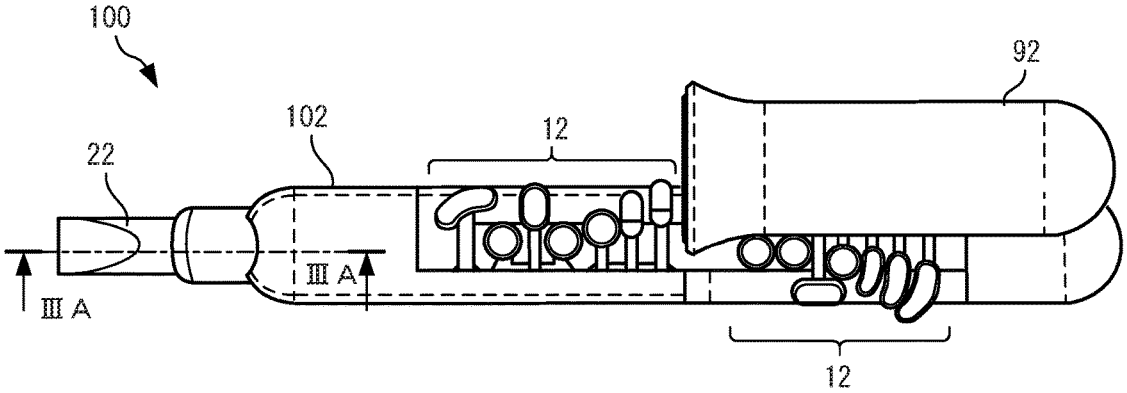
FIG. 2A to FIG. 2C are external views of a first embodiment of the electronic musical instrument according to the present invention.
Figure 2B:
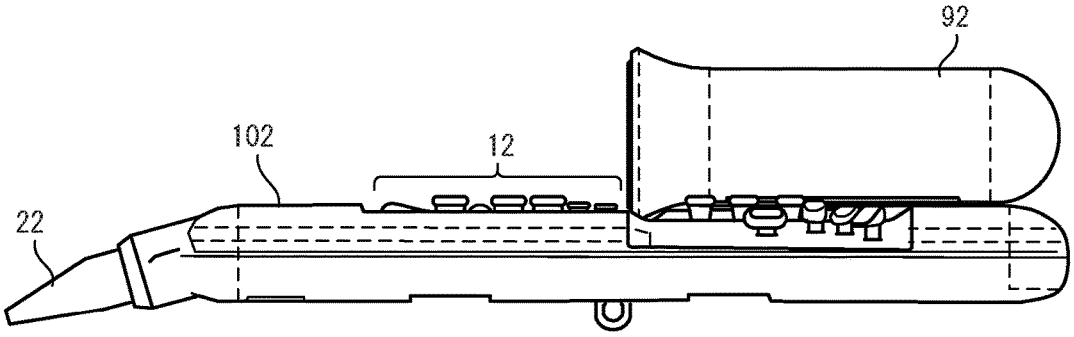
Figure 2C:
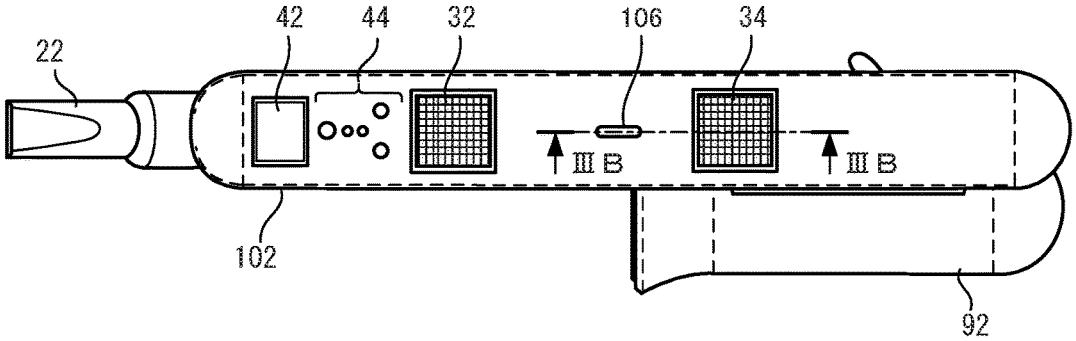
Figure 3A:
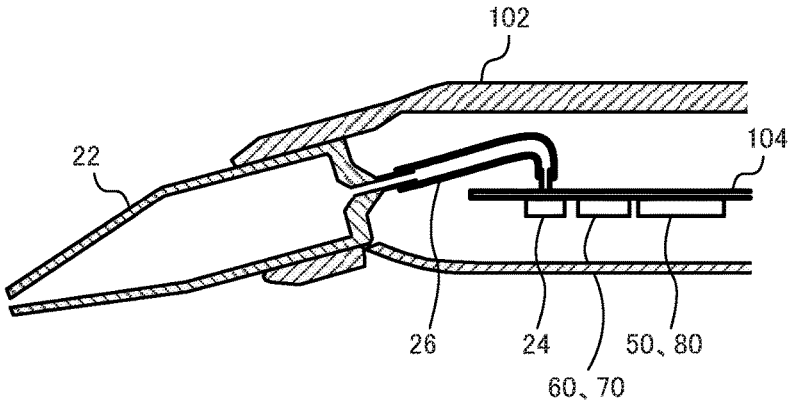
FIG. 3A and FIG. 3B are partial cross-sectional views of an example of the internal structure of the electronic musical instrument according to the first embodiment.
Figure 3B:
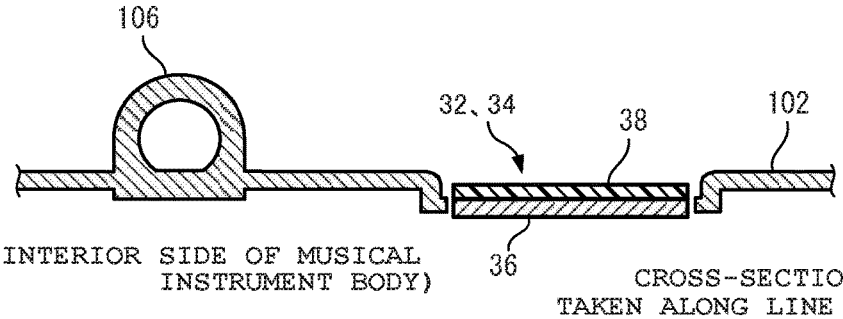

FIG. 1 is a block diagram showing an example of the functional structure of the electronic musical instrument according to the present invention. FIG. 2A to FIG. 2C are external views of a first embodiment of the electronic musical instrument according to the present invention. FIG. 2A is a front view of the electronic musical instrument according to the present embodiment, FIG. 2B is a side view of the electronic musical instrument, and FIG. 2C is a rear view of the electronic musical instrument. FIG. 3A and FIG. 3B are partial cross-sectional views of an example of the internal structure of the electronic musical instrument according to the first embodiment. FIG. 3A is a partial cross-sectional view of a mouthpiece, a board, and surrounding portions in the electronic musical instrument according to the present embodiment, and FIG. 3B is a partial cross-sectional view of a touchpad and surrounding portions in the electronic musical instrument.

For example, as shown in FIG. 1, an electronic musical instrument 100 according to the present invention mainly includes an operator 10 including scale keys (or pitch keys), a breath pressure detection section 20 including a mouthpiece and a pressure sensor, a function operation section 30 including a touchpad, a function setting section 40 including a display and a setting switch, a central processing unit (CPU) 50, a read only memory (ROM) 60, a random access memory (RAM) 70, a sound source 80, and a sound system 90 including a speaker. Note that the functional structure shown in FIG. 1 is merely an example for achieving the electronic musical instrument according to the present invention, and the present invention is not limited thereto.

For example, as shown in FIG. 2A to FIG. 2C, the electronic musical instrument 100 according to the first embodiment of the present invention has a shape modeled after the shape of a saxophone, which is an acoustic wind instrument. In the electronic musical instrument 100, a mouthpiece 22 to be held in the mouth of the instrument player is attached to one end (on the left end side in FIG. 2A to FIG. 2C) of a musical instrument body 102 having a tubular housing, and a speaker box 92 that outputs a musical sound is provided at the other end (on the right side in FIG. 2A to FIG. 2C).

In a side surface on the front side of the musical instrument body 102, scale keys (or pitch keys) 12 for determining scales (or pitches) are provided. In a side surface on the back side of the musical instrument body 102, touchpads 32 and 34 for controlling the polarity and intensity of an effect given to a musical sound, and a display 42 and a setting switch 44 for setting a parameter of the effect are provided. Inside the musical instrument body 102, a board 104 on which a pressure sensor 24, a CPU 50, a ROM 60, a RAM 70, and a sound source 80 are mounted is provided, as shown in FIG. 3A.

As shown in FIG. 2A and FIG. 2B, the operator 10 is provided in the side surface on the front side of the musical instrument body 102 and has scale keys 12 for specifying the scales of musical sounds. The operator 10 receives key operations performed on the scale keys 12 by the instrument player, and outputs information regarding the operations to the CPU 50. Here, key operations on the scale keys 12 are performed by changing key positions being pressed by the four fingers of each hand of the instrument player, which are the index finger to the little finger (except the thumb).

As shown in FIG. 2A, FIG. 2B and FIG. 3A, the breath pressure detection section 20 includes the mouthpiece 22 attached to one end of the musical instrument body 102, and the pressure sensor 24 mounted on the board 104 provided inside the musical instrument body 102. The breath pressure detection section 20 measures a pressure (a breath pressure) generated inside the mouthpiece 22 by using the pressure sensor 24 via a tube 26 when the instrument player blows their breath into the mouthpiece 22, and the breath pressure detection section 20 outputs information regarding the breath pressure to the CPU 50.

As shown in FIG. 2C, the function operation section 30 has the touchpads 32 and 34 provided in the side surface on the back side of the musical instrument body 102. The function operation section 30 receives an operation on the touchpads 32 and 34 by the instrument player, and outputs, to the CPU 50, effect operation information for controlling the polarity and intensity of an effect set in advance for the touchpads 32 and 34 so as to be given to a musical sound.

Here, the touchpads 32 and 34 are provided at two positions in total, and each of the positions (areas) is contacted with the corresponding one of the thumbs of both hands when the instrument player supports and holds the electronic musical instrument 100 with the both hands. In other words, the operation of the touchpad 32 is performed by changing, in a specific direction, the position (area) to be contacted with the left thumb of the instrument player, and the operation of the touchpad 34 is performed by changing, in a specific direction, the position (area) to be contacted with the right thumb of the instrument player. The function operation section 30 detects the contact positions of the respective thumbs in the respective touchpads 32 and 34, and outputs, to the CPU 50, the detected contact positions as effect operation information for controlling the polarity and intensity of a predetermined effect. A method for controlling the polarity and intensity of an effect to be given to a musical sound are described later in detail.

In the present embodiment, for example, a sensor device in which a plurality of electrodes of capacitive touch sensors is arrayed in a specific direction is applied as the touchpads 32 and 34. For example, as shown in FIG. 2C and FIG. 3B, each of the touchpads 32 and 34 includes a pad board 36 on which the sensor device is mounted, and a cover member 38 laminated so as to protect a surface of the sensor device, and is provided to be exposed in a rectangular planar shape such as a square or a rectangle on the back side of the musical instrument body 102. In the drawings, the reference numeral "106" denotes a strap ring that is used for the instrument player to hang and hold the electronic musical instrument 100 with a strap hung from the person's neck.

In the present embodiment, the structure is described in which the touchpads 32 and 34 are provided in the respective two areas to be contacted with the thumbs of both hands. However, the present invention is not limited thereto. For example, the electronic musical instrument 100 may have a structure in which a touchpad is provided in only one area and corresponds to the thumb of the right or left hand.

As shown in FIG. 2C, the function setting section 40 includes the display 42 such as a liquid crystal display (LCD) panel provided in the side surface on the back side of the musical instrument body 102, and the setting switch 44. The function setting section 40 receives an operation performed on the setting switch 44 by the instrument player, and outputs setting information specified by the operation to the CPU 50.

Here, by the instrument player operating the setting switch 44 based on information on the display 42 prior to a musical performance, the function setting section 40 outputs, to the CPU 50, setting information to set (assign) one or a plurality of effects selected from a plurality of prepared effects in advance to specific directions of the respective touchpads 32 and 34 of the function operation section 30. A method for setting the effects for the touchpads 32 and 34 is described later.

The CPU 50 is a computer that functions as a control unit for controlling each section of the electronic musical instrument 100. The CPU 50 reads a predetermined program stored in the ROM 60, develops the program in the RAM 70, and executes various types of processing in cooperation with the developed program. For example, the CPU 50 instructs the sound source 80 to produce a musical sound based on operation information inputted from the operator 10, breath pressure information inputted from the breath pressure detection section 20, and effect operation information inputted from the function operation section 30. Also, the CPU 50 determines an effect and its parameter to be set for each of the touchpads 32 and 34 of the function operation section 30, based on setting information inputted from the function setting section 40.

The ROM 60 is a read-only semiconductor memory. This ROM 60 stores various data and programs for controlling operations and processing in the electronic musical instrument 100. In particular, in the present embodiment, the ROM 60 stores a program to achieve a method for controlling the polarity and intensity of an effect to be given to a musical sound, which is applied to a later-described method for controlling the electronic musical instrument. The RAM 70 is a volatile semiconductor memory, and has a work area for temporarily storing data and programs read from the ROM 60, data produced during execution of the programs or various information outputted from the operator 10, the breath pressure detection section 20, the function operation section 30 and the function setting section 40.

The sound source 80 is a synthesizer. By following a musical sound production instruction outputted from the CPU 50, the sound source 80 performs musical sound synthesis to produce a musical sound signal based on operation information from the operator 10 and effect operation information from the function operation section 30 and outputs the signal to the sound system 90. The sound system 90 performs processing, such as signal amplification, for the musical sound signal inputted from the sound source 80, and outputs the processed musical sound signal as a musical sound from a speaker incorporated in the speaker box 92.

Next, the function operation section 30 and the function setting section 40 applied to the electronic musical instrument according to the present embodiment are specifically described. Here, a method for controlling the electronic musical instrument, which includes a method for an effect control operation in the function operation section 30 and a method for effect setting in the function setting section 40, is achieved by executing a specific control program in the above-described CPU 50.

(Function Operation Section 30: Method for Effect Control Operation)

Figure 4A:
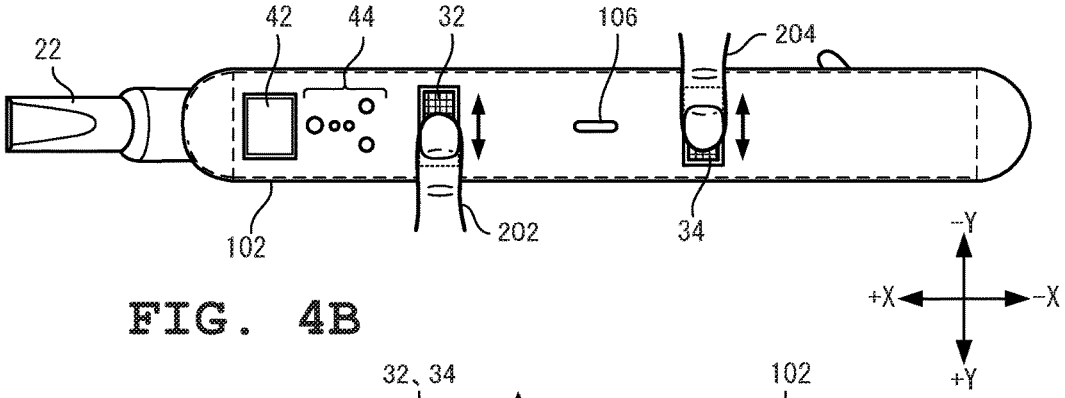
FIG. 4A to FIG. 4C are schematic diagrams of a first example of a touchpad applied to a function operation section according to the first embodiment.
Figure 4B:
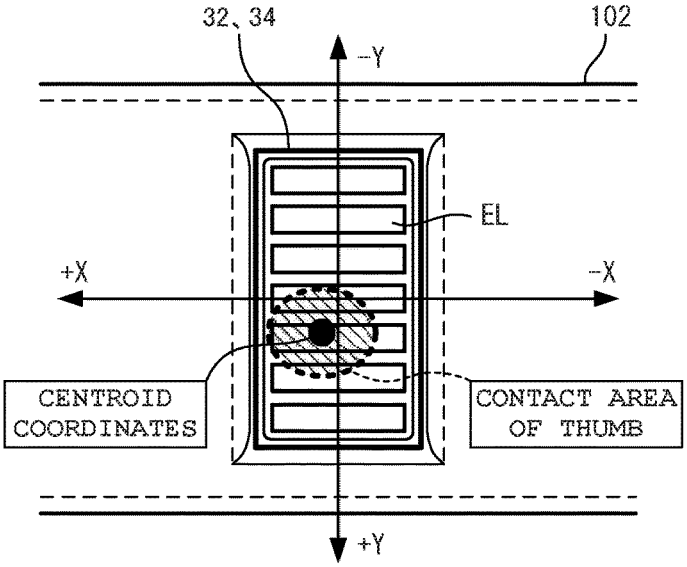
Figure 4C:
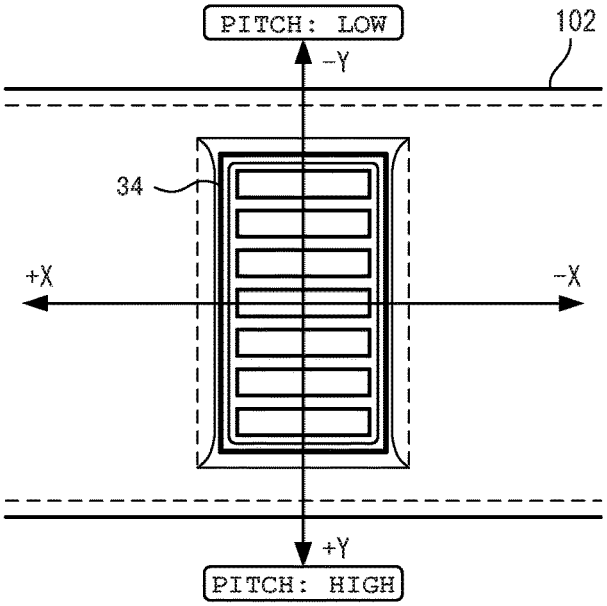

FIG. 4A to FIG. 4C are schematic diagrams showing a first example of touchpads applied to the function operation section 30 according to the present embodiment. FIG. 4A is a schematic diagram showing a state of thumbs in contact with the respective touchpads. FIG. 4B is a diagram showing coordinate axes in the touchpads. FIG. 4C is a diagram showing an example of an effect set for the touchpad.

As shown in FIG. 4A, in the electronic musical instrument 100 according to the present embodiment, the touchpad 32 of the function operation section 30 is arranged at a position (area) to be contacted with the left thumb 202 when an instrument player supports and holds the electronic musical instrument 100 with both hands, and the touchpad 34 is arranged at a position (area) to be contacted with the right thumb 204.

Each of the touchpads 32 and 34 is an assembly constituted by a plurality of electrodes of touch sensors arrayed in a specific direction. Specifically, when a longitudinal direction (the right-and-left direction in the drawings) in which the tubular housing of the musical instrument body 102 extends is taken as an X direction (a specific direction, a first direction), a plurality of electrodes EL of the touch sensors is arrayed at regular intervals in the touchpads 32 and 34 in a Y direction (a specific direction, a second direction), that is, a lateral direction perpendicular to the X direction, as shown in FIG. 4A and FIG. 4B. The touchpads 32 and 34 are provided in the respective areas which are satisfactorily contacted with the respective thumbs 202 and 204 when the thumbs 202 and 204 are moved in the Y direction as indicated with an arrow in FIG. 4A. Also, in the touchpads 32 and 34, the planar shape and size of the electrode EL of each of the touch sensors, the number of the electrodes EL arrayed, and the intervals between the electrodes EL arrayed are set such that the contact positions and the movement amounts of the thumbs 202 and 204 can be detected in sufficient resolution.

Here, as a technique for determining the contact positions of the thumbs 202 and 204, an algorithm may be applied which calculates centroid coordinates based on the contact areas of the thumbs 202 and 204 detected by the touchpads 32 and 34. According to this technique, by pushing, pulling, or rolling the thumbs 202 and 204 in the Y direction with the positions of the thumbs 202 and 204 on the respective touchpads 32 and 34 being substantially maintained, the above-described centroids are moved. Accordingly, by detecting an absolute position in barycentric coordinates on one axis (the Y-axis) or the amount of change (the amount of movement) at a relative position, the polarity and intensity of an effect to be set for each of the touchpads 32 and 34 can be controlled in accordance with the contact positions.

For example, in a case where a pitch bend is set for the touchpad 34 as an effect to be given to a musical sound as shown in FIG. 4C, when the right thumb 204 is in contact with the center position (zero point position) in the Y direction of the touchpad 34, a tone is controlled so as not to change. When the thumb 204 is moved in the +Y direction, a pitch is controlled so as to be changed (bent up) in a direction in which a tone becomes higher. When the thumb 204 is moved in the −Y direction, a pitch is controlled so as to be changed (bent down) in a direction in which a tone becomes lower. Also, when the thumb 204 is greatly moved in the +Y direction or the −Y direction, a tone is controlled so as to rapidly change. In contrast, when the thumb 204 is slightly moved in the +Y direction or the −Y direction, a tone is controlled so as to gently change.

In FIG. 4C, the case has been described in which a pitch bend is set for the touchpad 34 as an example of an effect to be given to a musical sound. However, the present invention is not limited thereto. For example, the electronic musical instrument 100 may be configured such that an effect (for example, modulation) other than a pitch bend is set for the touchpad 32 arranged in an area to be contacted with the left thumb 202, the polarity and intensity of different two effects can be simultaneously or individually controlled by the touchpads 32 and 34 during a musical performance. Alternatively, the electronic musical instrument 100 may be configured such that the same effect (for example, a pitch bend) is set for the touchpads 32 and 34, so that the polarity and intensity of the same effect can be controlled right and left with either of the thumbs 202 and 204.

(Function Setting Section 40: Method for Effect Setting)

FIG. 5 is a schematic diagram showing a first example of a method for setting an effect for a touchpad in the function setting section 40 according to the present embodiment. Here, a case is described in which respectively different effects are set (assigned) to the different touchpads 32 and 34 of the function operation section 30.

In the electronic musical instrument 100 according to the present embodiment, the display 42 and the setting switch 44 of the function setting section 40 are provided on the side surface which is located on the back side of the musical instrument body 102 and on which the above-described touchpads 32 and 34 are arranged, as shown in FIG. 4A.

Figure 5B:
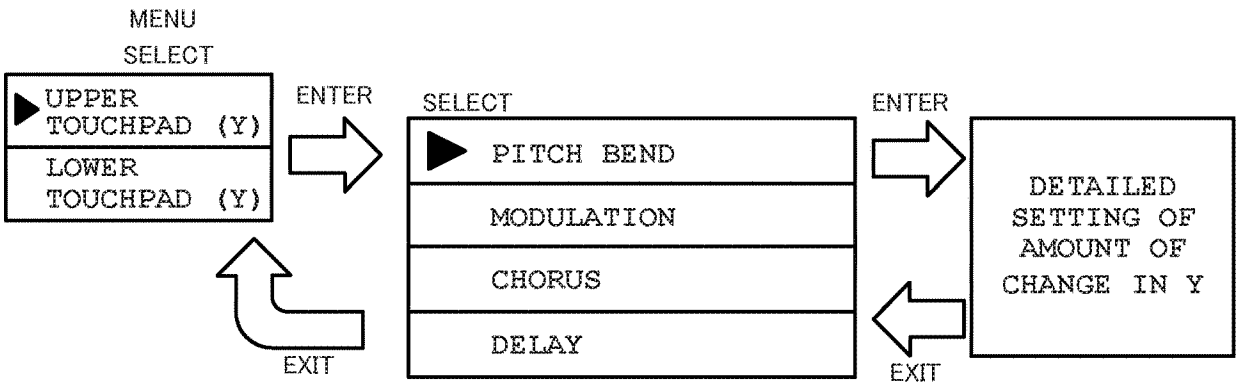
FIG. 5A and FIG. 5B are schematic diagrams showing a first example of a method for setting an effect for the touchpad in a function setting section according to the first embodiment.
Figure 5A:
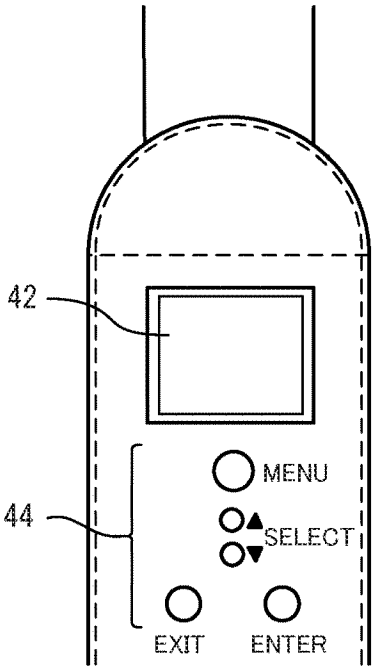

Specifically, the setting switch 44 includes a MENU key, a SELECT key, an ENTER key, and an EXIT key, for example, as shown in FIG. 5A.

In this case where the touchpad 32 arranged at one end (at the left end in FIG. 4A) of the musical instrument body 102 is taken as an upper touchpad and the touchpad 34 is taken as a lower touchpad, the MENU key is used to display a screen for selection between the upper and lower touchpads 32 and 34, as shown in FIG. 5B.

The SELECT key is used to make a selection between the up and lower touchpads 32 and 34 and a selection between effects (for example, four effects such as PITCH BEND, MODULATION, CHORUS and DELAY), and set a set value for a selected effect, as shown in FIG. 5B. Here, examples of typical effects set for (assigned to) the touchpads 32 and 34 shown in FIG. 4B and set values for the effects are described.

(1) PITCH BEND: an effect of adjusting a pitch so as to continuously change a tone. The gradient of change in tone (a tone that gently or dramatically changes) is set as a set value.

(2) MODULATION: an effect by which a tone changes up and down in regular cycles, so that a sound is heard as if it is swinging. The minimum (MIN) and the maximum (MAX) values of the cycle of change in tone, and the directions of the MIN and MAX on an axis are set as set values.

(3) CHORUS: an effect of synthesizing (MIX) a reverberating sound with an original sound. When the amount of MIX (the amount of SEND) is larger, more reverberating sounds are contained, and the degree of the effect becomes larger, accordingly. The MIN and MAX values of the depth of chorus (the amount of SEND of effect sounds) and the directions of the MIN and MAX on an axis are set as set values.

(4) DELAY: an effect of synthesizing (MIX) a delayed sound with an original sound. The MIN and MAX values of delay time and the directions of the MIN and MAX on an axis are set as set values. The delay time denotes the setting of time to be elapsed until a delay sound is emitted.

The ENTER key is used to finalize an item selected on a screen for selection or the like and cause a transition to the following screen. The EXIT key is used to cause a transition to the previous screen after the finalization using the ENTER key.

In this function setting section 40, when an effect is to be set for the upper and lower touchpads 32 and 34, first, the instrument player operates the MENU key prior to a musical performance so as to display a screen for selection between the upper and lower touchpads 32 and 34 on the display 42, as shown in FIG. 5B.

Subsequently, with reference to the selection screen displayed on the display 42, the instrument player operates the SELECT key to select a touchpad 32 or 34 where an effect is set. Then, the instrument player operates the ENTER key to finalize the selected touchpad and display a screen for selection from a plurality of preset effects (such as four effects including PITCH BEND. MODULATION, CHORUS and DELAY) on the display 42.

Next, with reference to the screen for selection displayed on the display 42, the instrument player operates the SELECT key to select an effect to be set for the touchpad. Then, the instrument player operates the ENTER key to finalize the selected effect. Then, the instrument player inputs a set value related to the effect (for example, the above-described (1), (2), (3) or (4)). The method for inputting the set value here may be performed such that the instrument player directly inputs an arbitrary set value by operating the SELECT key, or the instrument player selects one of a plurality of prepared set values in advance. After the selection of an effect and the input of a set value, the instrument player operates the EXIT key to return to the screen for selection between the touchpads 32 and 34, and selects a touchpad for which any effect has not been set yet. That is, the above-described series of operations are repeatedly performed.

As described above, the present embodiment (the first example) includes the one-dimensional touchpads 32 and 34 where a plurality of electrodes EL of touch sensors have been arrayed in the lateral direction (the Y direction) perpendicular to the longitudinal direction (the X direction) of the musical instrument body 102. By the positions of centroids corresponding to the contact positions of the instrument player's thumbs 202 and 204 being respectively moved in the Y direction, the polarity and intensity of an effect are controlled.

According to this electronic musical instrument 100, when the polarity and intensity of an effect are to be controlled during a musical performance, the contact positions of the thumbs 202 and 204 of the hands are moved in the lateral direction of the musical instrument body 102 and scarcely moved in the longitudinal direction (the X direction). In addition, the positions of the centroids are moved corresponding to the contact positions of the thumbs 202 and 204 in close contact with the touchpads 32 and 34. Therefore, it is less likely to cause a change in the positions of a fulcrum and a power point on which the musical instrument body 102 is supported by the thumbs 202 and 204 and one to four fingers of each hand, that is, the index to little fingers corresponding to the thumbs, and a change in the magnitude of a force to support the musical instrument body 102. Thus, while controlling the polarity and intensity of an effect in accordance with the contact position of each of the thumbs 202 and 204, the instrument player can stably support the musical instrument body 102 with these thumbs 202 and 204. Furthermore, from an ergonomic viewpoint, the inventors' study has revealed that, when an operation of specifying a scale is being performed by operating scale keys 12 with four fingers of each hand, that is, the index finger to the little finger, the thumbs 202 and 204 can be easily moved in the lateral direction (the Y direction) of the musical instrument body 102, and are less easily moved in the longitudinal direction (the X direction) as compared with the lateral direction.

Also, according to the present embodiment, one different effect can be arbitrarily set for each of the touchpads 32 and 34, whereby diverse and rich musical performances and musical sounds caused by a plurality of effects can be achieved by simple operations.

In the present embodiment (the first example), the structure has been described in which a plurality of electrodes EL of touch sensors of each of the touchpads 32 and 34 is arrayed in the lateral direction (the Y direction) of the musical instrument body 102, as shown in FIG. 4. However, the present invention is not limited thereto. Each of the touchpads 32 and 34 may have a structure in which a plurality of electrodes EL of touch sensors is arrayed in the longitudinal direction (the X direction) of the musical instrument body 102.

Here, as described above, in order to stably support the musical instrument body 102 while controlling an effect during a musical performance, it is more effective in terms of ergonomics to change the contact positions of the thumbs 202 and 204 in the lateral direction of the musical instrument body 102. However, the present invention does not exclude a configuration where an operation of moving the thumbs 202 and 204 in the longitudinal direction (the X direction) of the musical instrument body 102 is adopted. In other words, it is merely relatively more difficult to move the thumbs 202 and 204 when they are moved in the longitudinal direction (the X direction) of the musical instrument body 102, as compared with the case where the thumbs 202 and 204 are moved in the lateral direction (the Y direction) of the musical instrument body 102. Even in the structure where a plurality of electrodes EL of touch sensors of each of the touchpads 32 and 34 is arrayed in the longitudinal direction (the X direction) of the musical instrument body 102 as described above, an effect can be satisfactorily controlled during a musical performance. In this case, it is slightly difficult to move the thumbs 202 and 204 in the longitudinal direction (the X direction) during a musical performance. Therefore, for example, by setting an effect capable of permitting some delay time in the X direction, the thumbs 202 and 204 can stably support the musical instrument body 102 while satisfactorily controlling the effect during a musical performance. In contrast, the present embodiment (the first example) provides the structure in which, even when an effect with high real-time property and high responsivity is set in the Y direction, the thumbs can stably support the musical instrument body 102 while satisfactorily controlling the effect during a musical performance. Such relation between the ease of movement of the thumbs in the X direction and the Y direction and effects set in the respective directions is similarly taken into consideration in the later-described embodiment and modification.

Also, as described above, in the case where a finger is moved in the X direction on a touchpad, or in the case where a pressing force against a touchpad is intentionally changed as described in the following second embodiment, it is sometimes difficult, with a structure in which only one touchpad is provided in the musical instrument body, to stably support the musical instrument body during an operation. Therefore, by the structure where two touchpads in total are provided, that is, the touchpads are provided at the respective positions corresponding to the respective thumbs of both hands, and the above-described difficult operation is not simultaneously performed by the two touchpads but performed by only one of the touchpads by only one of them being operated or the touchpads being used in turns, the musical instrument body 102 can be stably supported during an operation.

Furthermore, in the present embodiment (the first example), effects set respectively for the two touchpads 32 and 34 provided in the musical instrument body 102 may be different as described, or may be the same. In the latter case, by either of the left or right thumbs, the operation of controlling an effect and the operation of supporting the musical instrument body 102 can be performed. Therefore, by supporting the musical instrument body 102 with a thumb that is not involved in an effect control operation in accordance with a musical performance state, the musical instrument body 102 can be stably supported.

Still further, in the present embodiment, the structure has been described in which, in the two touchpads 32 and 34 provided in the musical instrument body 102, a plurality of electrodes EL of touch sensors is arrayed in the same direction (the Y direction). However, the present invention is not limited thereto, and a structure may be adopted in which a plurality of electrodes EL of touch sensors of the touchpad 32 is arrayed in a direction different from a direction in which a plurality of electrodes EL of touch sensors of the touchpad 34 is arrayed. That is, for example, a structure may be adopted in which a plurality of electrodes EL of touch sensors of the upper touchpad 32 is arrayed in the longitudinal direction (the X direction) of the musical instrument body 102, and a plurality of electrodes EL of touch sensors of the lower touchpad 34 is arrayed in the lateral direction (the Y direction) of the musical instrument body 102.

Next, a second example of the function operation section and the function setting section 40 which are applied to the electronic musical instrument according to the present embodiment is described. Here, a structure and a method that are equivalent to those of the above-described first example are briefly described.

Figure 6A:
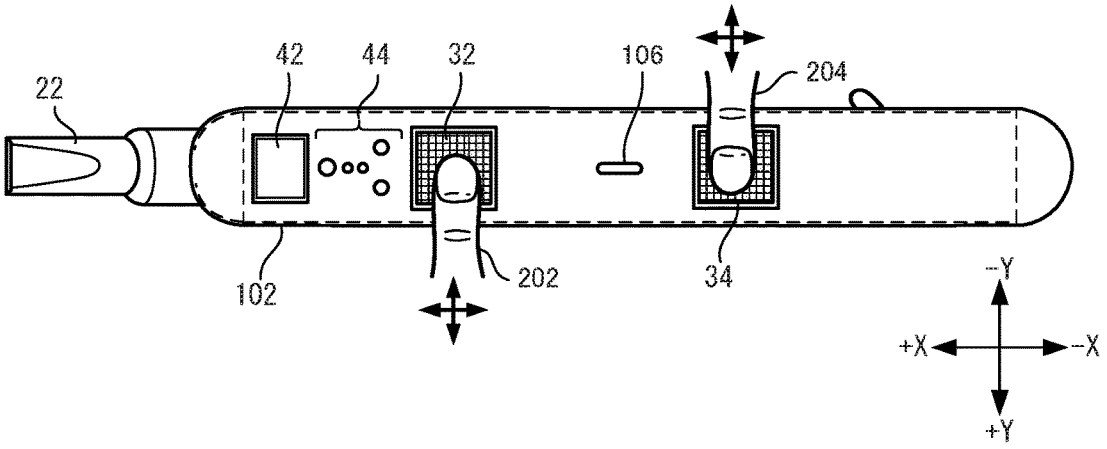
FIG. 6A and FIG. 6B are schematic diagrams showing a second example of the touchpad applied to the function operation section according to the first embodiment.
Figure 6B:
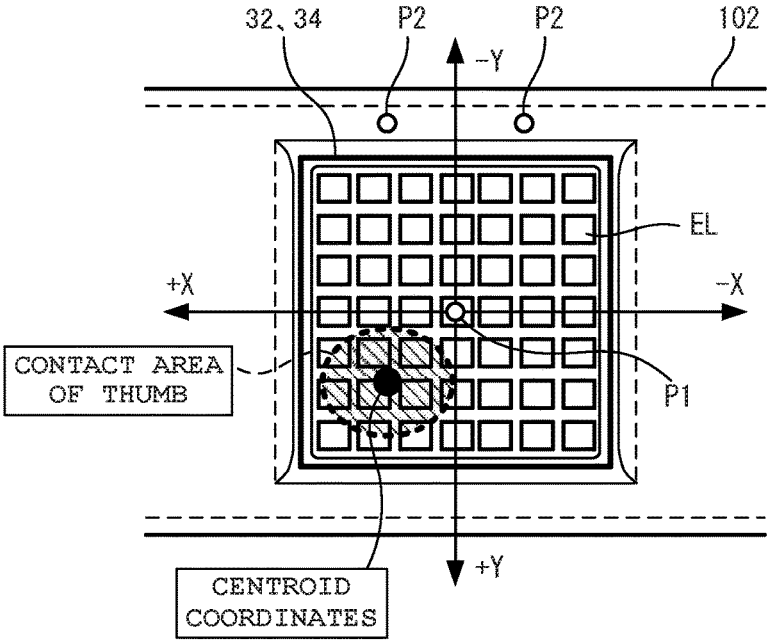
Figure 7:
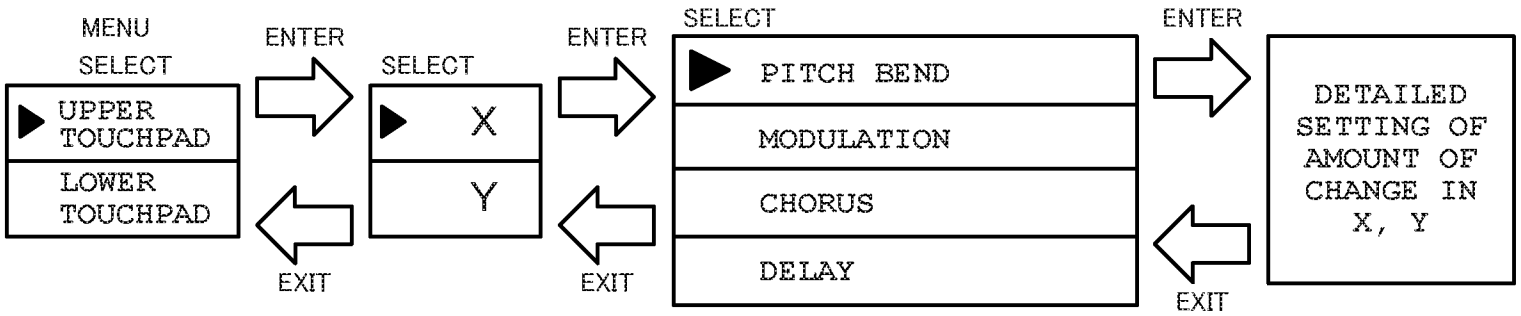
FIG. 7 is a schematic diagram showing a second example of the method for setting effects to the touchpad in the function setting section according to the first embodiment.
Figure 8B:
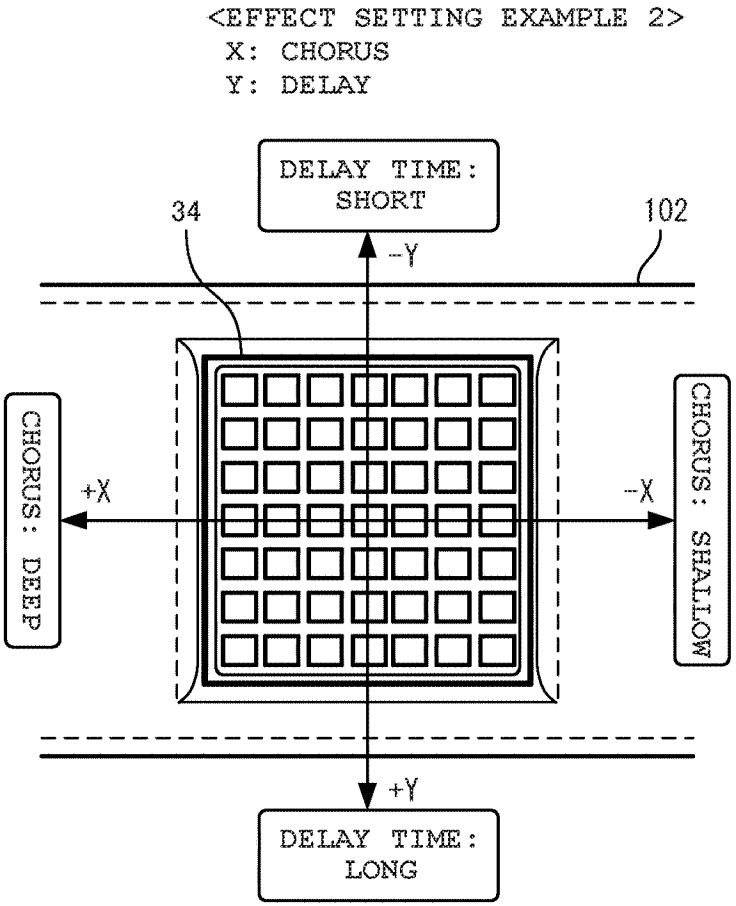
FIG. 8A and FIG. 8B are diagrams showing an example of effects set for the touchpad applied to the function operation section according to the first embodiment.
Figure 8A:
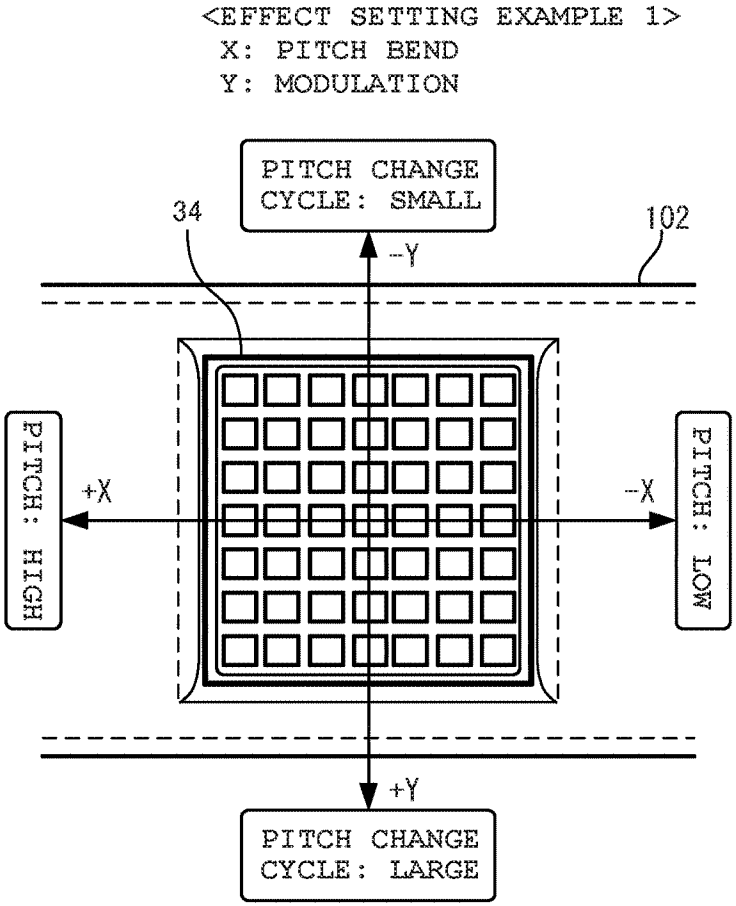

FIG. 6A and FIG. 6B are schematic diagrams showing a second example of touchpads applied to the function operation section according to the present embodiment. FIG. 6A is a schematic diagram showing a contact state of thumbs with the touchpads, and FIG. 6B is a diagram showing coordinate axes in each of the touchpads. FIG. 7 is a schematic diagram showing a second example of a method for setting an effect for the touchpads in the function setting section according to the present embodiment. FIG. 8A and FIG. 8B are diagrams showing an example of effects set for the touchpad applied to the function operation section according to the present embodiment.

In the above-described first example of the function operation section 30, the structure and the method for controlling the polarity and intensity of an effect have been described in which one-dimensional touchpads in each of which a plurality of electrodes EL of touch sensors is arrayed in one specific direction (the Y direction or the X direction) is used as the touchpads 32 and 34. In the second example, a structure and a method for controlling the polarity and intensity of an effect are described in which two-dimensional touchpads in each of which a plurality of electrodes EL of touch sensors is arrayed in the Y direction and the X direction is used as the touchpads 32 and 34.

Specifically, as shown in FIG. 6A and FIG. 6B, a two-dimensional touchpad is applied as each of the touchpads 32 and 34 of the function operation section 30 which are arranged in areas to be contacted with the thumbs 202 and 204 supporting the electronic musical instrument 100. Each of the touchpads 32 and 34 is an assembly constituted by a plurality of electrodes EL of touch sensors arrayed in a grid form in two directions perpendicular to each other. In the present embodiment, a plurality of electrodes EL of touch sensors is arrayed at regular intervals in each of the longitudinal direction (the X direction) and the lateral direction (the Y direction) of the musical instrument body 102. Such touchpads 32 and 34 are provided in the respective areas capable of being satisfactorily contacted with the respective thumbs 202 and 204 when the thumbs 202 and 204 are moved in the X direction and the Y direction as indicated with an arrow in FIG. 6A, and the planar shape and size of electrodes EL of each of the touch sensors, the number of arrayed electrodes EL and the intervals between the arrayed electrodes are set such that the contact positions and the movement amounts of the thumbs 202 and 204 can be detected in sufficient resolution.

In the present embodiment, using such touchpads 32 and 34, the contact positions of the thumbs 202 and 204 are calculated as centroid coordinates, and the absolute positions at the centroid coordinates with two X-Y axes or the amount of change (the amount of movement) at a relative position are detected, whereby the polarity and intensity of effects set in the respective touchpads 32 and 34 are controlled in accordance with the respective contact positions.

A method for setting (assigning) an effect to be given to a musical sound to each of the touchpads 32 and 34 is executed in the same manner as in the above-described embodiment by using the display 42 and the setting switch 44 of the function setting section 40.

In the present embodiment, when an effect is to be set for the upper and lower touchpads 32 and 34, a screen for selection between the upper and lower touchpads 32 and 34 is displayed on the display 42 by the MENU key of the setting switch 44 being operated, and a touchpad 32 or 34 where an effect is set is selected by the SELECT key being operated, whereby a screen for selection between the X-axis and the Y-axis in the selected touchpad 32 or 34 is displayed on the display 42, as shown in FIG. 7. Then, after the X-axis or the Y-axis where an effect is set is selected by the SELECT key being operated, an arbitrary effect is selected from a plurality of preset effects (such as four effects including PITCH BEND, MODULATION, CHORUS and DELAY) displayed on the display 42, and a set value for the effect is inputted, as in the case of the above-described embodiment. This series of operations for effect setting is repeated for each axis of the touchpads 32 and 34.

For example, by the above-described method for effect setting, when PITCH BEND is set for the X-axis of an arbitrary touchpad 32 or 34 (here, 34) and MODULATION is set for the Y-axis thereof as effects to be given to a musical sound as shown in FIG. 8A, control is performed such that a pitch is bent up when the thumb 204 is moved in the +X direction of the touchpad 34, and a pitch is bent down when the thumb 204 is moved in the −X direction of the touchpad 34. Furthermore, the cycle of change in tone is controlled to be larger (longer) when the thumb 204 is moved in the +Y direction of the touchpad 34, and the cycle of change in tone is controlled to be smaller (shorter) when the thumb 204 is moved in the −Y direction of the touchpad 34.

For example, when CHORUS is set for the X-axis of an arbitrary touchpad 32 or 34 (here, 34) and DELAY is set for the Y-axis thereof as effects to be given to a musical sound as shown in FIG. 8B, control is performed such that, when the thumb 204 is moved in the +X direction of the touchpad 34, the amount of SEND of a reverberating sound becomes larger and a deeper chorus effect is produced accordingly, and control is performed such that, when the thumb 204 is moved in the −X direction of the touchpad 34, the amount of SEND of a reverberating sound becomes smaller and a shallower chorus effect is produced accordingly. Furthermore, the delay time is controlled to be longer when the thumb 204 is moved in the +Y direction of the touchpad 34, and to be shorter when the thumb 204 is moved in the −Y direction of the touchpad 34.

As described above, in the electronic musical instrument according to the present embodiment (the second example), when the polarity and intensity of an effect are to be controlled during a musical performance, the contact positions of the thumbs 202 and 204 of the hands change within a two-dimensional (touchpad) plane in a comparatively narrow range including the lateral direction of the musical instrument body 102, and the positions of the centroids are moved corresponding to the contact positions of the thumbs 202 and 204 in close contact with the touchpads 32 and 34. Accordingly, it is less likely to cause a change in the positions of a fulcrum and a power point on which the musical instrument body 102 is supported with the thumbs 202 and 204 and one to four fingers of each hand, that is, the index to little fingers corresponding to the thumbs, and a change in the magnitude of a force to support the musical instrument body 102. Thus, while controlling the polarity and intensity of effects in accordance with the contact positions of the thumbs 202 and 204, the instrument player can stably support the musical instrument body 102 with these thumbs 202 and 204.

Furthermore, according to the present embodiment, up to two different effects can be arbitrarily set for each of the touchpads 32 and 34, whereby more diverse and richer musical performances and musical sounds caused by a plurality of effects can be achieved by simple operations. That is, the present embodiment is not limited to a case where the effect shown in FIG. 8A or the effect shown FIG. 8B is set for one of the touchpads 32 and 34. For example, by the effect shown in FIG. 8A being set for the touchpad 32 and the effect shown in FIG. 8B being set for the touchpad 34, the touchpad 32 and 34 allow the polarity and intensity of different four effects to be simultaneously or individually controlled during a musical performance. Also, by effects being set for the touchpads 32 and 34 such that an effect set for the touchpad 32 is partially or entirely the same as an effect set for the touchpad 34, the polarity and intensity of an effect common in the touchpads 32 and 34 can be controlled right and left with either of the thumbs 202 and 204.

In the present embodiment (the second example), an arbitrary effect is set in each of the directions of the two X, Y axes in the two-dimensional touchpads 32 and 34. However, the present invention is not limited thereto. For example, by an effect being set only in the Y direction and no effect being set in the X direction, a structure equivalent to the first example of the above-described embodiment (refer to FIG. 4) can be achieved. As a result, the two-dimensional touchpads 32 and 34 can be arbitrarily used as one-dimensional or two-dimensional touchpads, and the instrument player can use a favorable musical performance method while stably supporting the musical instrument body 102 during a musical performance.

Note that, in each of the above-described embodiments, the contact positions of the respective thumbs on the respective touchpads 32 and 34 are acquired as effect operation information, and used to control the polarity and intensity of effects during a musical performance. On the other hand, since an instrument player cannot see the movement of their thumbs during a musical performance, the instrument player cannot correctly recognize the positions of the thumbs, and therefore sometimes needs to adjust the contact positions of the thumbs while checking, through an acoustic sense, a musical sound subjected to an effect and actually emitted. In a case like this, an effect may not be appropriately given to a musical sound, and therefore a musical performance intended by the instrument player may not be achieved.

Therefore, the present invention may adopt a structure where the contact positions of the thumbs on the touchpad 32 and 34, and the directions (the X direction, the Y direction) in which a plurality of electrodes EL of touch sensors of each of the touchpads 32 and 34 is arrayed can be recognized based on the tactile sense of each thumb. Examples of such structure include a structure where a single or continuous projections or recesses are provided at the center position (zero position) P1 or a specific coordinate position in the X-Y coordinates of the touchpad 32 or 34, or a position P2 which is located along the X direction and the Y direction of the touchpad 32 or 34 or in the circumferences of the touchpad 32 or 34 and is contacted with a thumb when an effect control operation is performed, as shown in FIG. 6B.

In another structure, a software-based technique using specific operation processing is applied. In the hardware-based technique in which a projection or a recess is provided in the above-described touchpads 32 and 34 or their surroundings, the instrument player is forced to recognize an absolute position, such as a center position or a specific coordinate position. In contrast, in the software-based technique, for example, at timing at which the instrument player touches an arbitrary position on the touchpad 32 or 34 with the thumb 202 or 204, processing (what is called calibration processing) for setting this position (hereinafter, referred to as an "initial contact position") to be the center position of X-Y coordinates is performed so as to detect a change of the position of the thumb as a coordinate position with respect to the center position. In another structure to which a software-based technique is applied, for example, at timing at which the instrument player touches arbitrary positions on the touchpad 32 or 34 with the thumb 202 or 204, a difference between the center position of X-Y coordinates that is set in advance on the touchpad 32 or 34 and the above-described initial contact position is memorized, and processing to rectify the above-described difference based on the coordinate position of the thumb detected in the X-Y coordinates is performed.

(Comparison Verification)

Next, superiority of the operation effect of the electronic musical instrument according to the present embodiment is verified by using a comparative example. Note that descriptions of sections equivalent to those in the above-described embodiments are simplified herein.

Figure 9B:
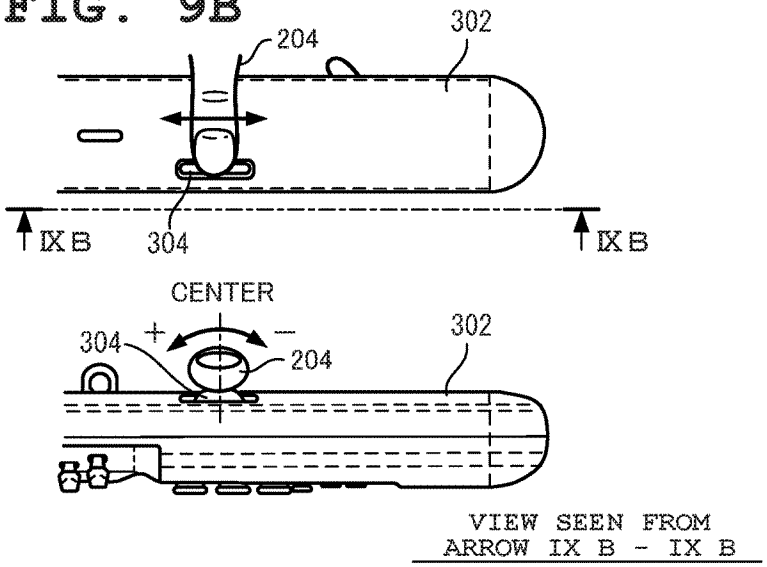
FIG. 9A to FIG. 9C are schematic diagrams showing a comparative example to describe an action effect of the electronic musical instrument according to the first embodiment.
Figure 9C:
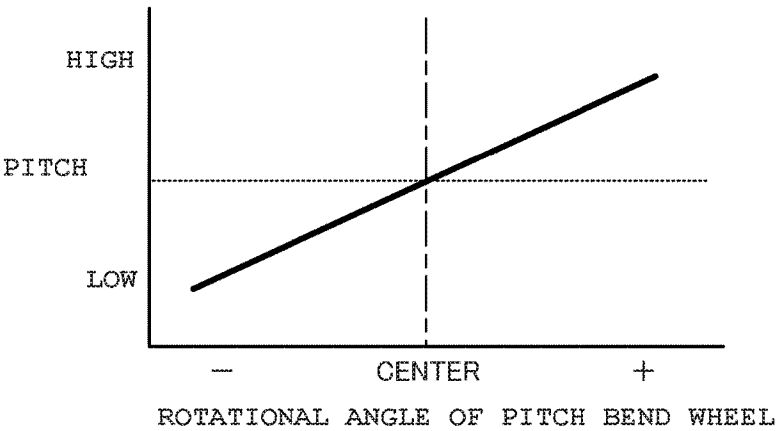
Figure 9A:
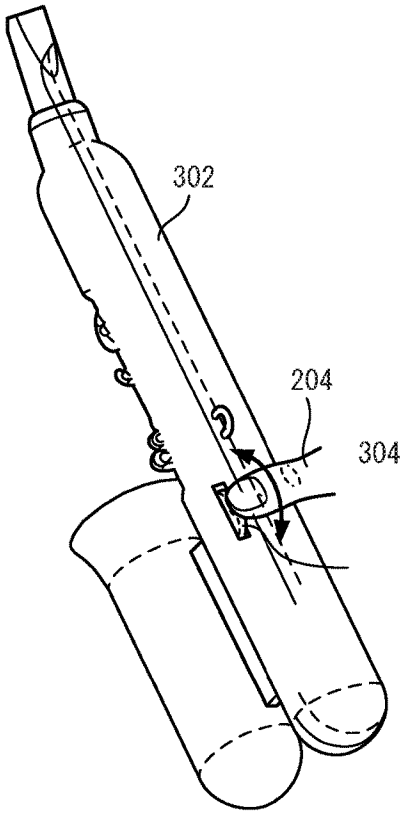

FIG. 9A to FIG. 9C are schematic diagrams showing the comparative example to describe an action effect of the electronic musical instrument according to the present embodiment. FIG. 9A is an external view of the comparative example when viewed from the rear side, FIG. 9B is a diagram showing an operation example of the comparative example, and FIG. 9C is a diagram showing the pitch bend change characteristics of the comparative example.

In the electronic musical instrument (comparative example) that is a comparison target for the electronic musical instrument according to the present embodiment, a rotary operator (bend wheel) 304 for pitch bend adjustment is provided at a position which is located on the back side of the musical instrument body 302 having a saxophone-like shape and is contacted with the instrument player's right thumb 204 when the instrument player plays the electronic musical instrument, as shown in FIG. 9A and FIG. 9B. This bend wheel 304 is configured such that, when the instrument player rotates the periphery of the bend wheel 304 with the fingertip of the thumb 204 in a rotational direction (indicated with an arrow in the drawing) along the longitudinal direction of the musical instrument body 302 as shown in FIG. 9B, a resistance value of a volume resistor (omitted in the drawing) provided inside the musical instrument body 302 is changed.

Furthermore, this electronic musical instrument performs the control of modulating the frequency of an emitted scale by using, as a parameter, a resistance value of the volume resistor that changes in accordance with the rotation angle of the bend wheel 304, and thereby increases (bending up) or decreases (bending down) a tone, as shown in the pitch bend change characteristics in FIG. 9C. In the comparative example shown in FIG. 9, a tone is bent up by rotating the bend wheel 304 toward+(plus) side. Also, a tone is bent down by rotating the bend wheel 304 toward−(minus) side.

In the comparative example, in order to adjust a pitch bend with the musical instrument body 302 being supported and held with both hands, it is necessary to rotate the bend wheel 304 with the thumb 204. When the thumb 204 is greatly moved in the rotational direction (that is, the longitudinal direction of the musical instrument body 302) in this state, a fulcrum on which the musical instrument body 302 is supported is moved, and a force to support the musical instrument body 302 becomes unstable because the thumb 204 is placed on the rotating bend wheel 304, whereby the musical instrument body 302 cannot be stably supported. Thus, performing a musical piece performance operation or an effect control operation becomes difficult or the operation becomes unstable, whereby the instrument player may fail to perform an intended musical performance.

In contrast, in each of the above-described embodiments, the touchpads 32 and 34 are provided in the respective areas which are located on the back side of the musical instrument body 102 and are contacted with the right and left thumbs 202 and 204, and each of the touchpads 32 and 34 has a structure in which a plurality of electrodes of touch sensors is arrayed at least in a specific direction (the longitudinal direction or the lateral direction) of the musical instrument body 102. Also, in each of the embodiments, when the instrument player moves the thumbs 202 and 204 on the respective touchpads 32 and 34 in a direction including the above-described specific direction (for example, the lateral direction), the polarity and intensity of an effect, such as a pitch bend, are controlled.

In particular, by moving the thumbs on the respective touchpads in a rolling manner, the instrument player can change the contact positions of the respective thumbs without loosening a force to press the thumbs against the respective touchpads. That is, when moving the thumbs on the respective touchpads in a sliding manner, the instrument player needs to slide the thumbs after loosening a force to press the thumbs against the respective touchpads in order to reduce frictional resistance. In contrast, such operation is not necessary in the movement in a rolling manner, and therefore the instrument player can stably support the musical instrument body even during an operation.

Thus, when an effect is to be controlled during a musical performance by the electronic musical instrument 100, the contact positions of the respective thumbs 202 and 204 of the hands change within the planes of the respective touchpads 32 and 34 in a comparatively narrow range including a specific direction on the back side of the musical instrument body 102, and the positions of the centroids move in accordance with the contact positions of the thumbs 202 and 204 in close contact with the touchpads 32 and 34. Therefore, it is less likely to cause a change in the positions of a fulcrum and a power point on which the musical instrument body 102 is supported with the thumbs 202 and 204 and one to four fingers of each hand, that is, the index to little fingers corresponding to the thumbs, and a change in the magnitude of a force to support the musical instrument body 102. Thus, while controlling the polarity and intensity of an effect in accordance with the contact positions of the thumbs 202 and 204, the instrument player can stably support the musical instrument body 102 with these thumbs 202 and 204.

Moreover, according to the present embodiment, the touchpads 32 and 34 are provided in the respective areas corresponding to the thumbs 202 and 204 of the hands, and one or a plurality of different effects can be arbitrarily set for each of the touchpads 32 and 34, whereby diverse and rich musical performances and musical sounds caused by various effects can be achieved by simple operations. Furthermore, since the touchpads 32 and 34 are provided in the respective areas corresponding to the thumbs 202 and 204 of both hands, while controlling an effect with a right or left thumb, the instrument player can stably support the musical instrument body 102 with the other thumb not performing the effect control operation.

In the above-described embodiments, by operations on the touchpads by thumbs, effects are controlled. However, the present invention is not limited thereto, and other control related to the emission of musical sounds may be performed. Examples of this control include the control of silencing, the control of sound volume and the control of switching of scale assignment specified by an operator.

(Modification Example)

Next, a modification example of the electronic musical instrument according to the above-described first embodiment is described. Note that descriptions of sections and methods equivalent to those in the above-described embodiments are simplified herein.

Figure 10A:
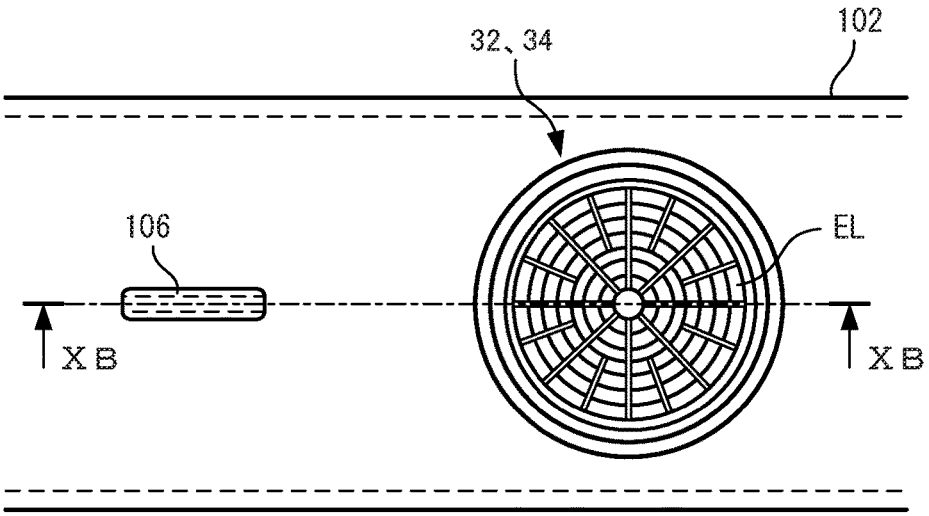
FIG. 10A and FIG. 10B are schematic diagrams showing a modification example of the electronic musical instrument according to the first embodiment.
Figure 10B:
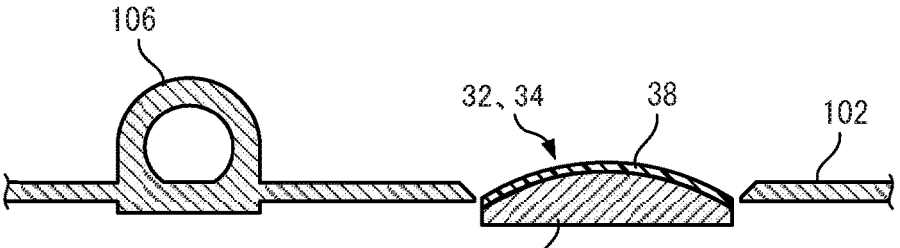

FIG. 10A and FIG. 10B are schematic diagrams showing the modification example of the electronic musical instrument according to the present embodiment. FIG. 10A is a schematic diagram of a touchpad, and FIG. 10B is a partial cross-sectional view of the touchpad and its surroundings.

In the first embodiment, the case has been described in which the touchpads 32 and 34 of the function operation section 30 have a rectangular planar shape. However, the present invention is not limited thereto. For example, as the modification example, the touchpads 32 and 34 may have a domed or projecting shape having a curved or spherical surface, as shown in FIG. 10A and FIG. 10B. In this modification example as well, the touchpads 32 and 34 each have a pad board 36 mounted with a sensor device in which a plurality of capacitive touch sensors is arrayed, and a cover member 38 laminated so as to protect a surface of the sensor device, and are provided to be exposed on the back side of the musical instrument body 102, as shown in FIG. 10B. These touchpads 32 and 34 have a round or elliptical planar shape.

In a case where the touchpads 32 and 34 having a curved surface projecting outward from the housing of the musical instrument body 102 are applied as in this modification example, areas where the thumbs 202 and 204 come in contact with the surfaces of the respective touchpads 32 and 34 in order to control the polarity and intensity of a predetermined effect are smaller as compared to the case in which the touchpads 32 and 34 have a flat surface as described in the embodiments described above. Therefore, in the present modification example, the positions of centroids (centroid coordinates) corresponding to the contact positions of the thumbs can be detected with higher accuracy and higher resolution, which enables a delicate effect control operation, whereby more diverse and richer musical performances and musical sounds can be achieved. Note that, in the present modification example, the contact positions of the respective thumbs 202 and 204 detected by the respective touchpads 32 and 34 having a curved surface may be detected as X-Y (orthogonal) coordinates on the above-described curved surface, in the longitudinal direction (the X direction) and the lateral direction (the Y direction) of the musical instrument body 102, or may be detected as polar coordinates formed of an angle obtained using a specific reference point as a center point (for example, a rotational angle on the basis of the X direction or the Y direction) and a distance (radius) from the center point.

As described above, in the present embodiment, any structure in which, when an effect is to be controlled, the contact positions of thumbs can be appropriately detected with simple and good operability being maintained may be applied as a modification. Therefore, the array structure of the plurality of electrodes of the touch sensors constituting each sensor device is not limited to the structure where the electrodes are arrayed in a grid form in the X-Y directions as shown in the above-described embodiment (the second example), and a structure where the electrodes are radially arrayed as shown in the present modification example (FIG. 10A) or a structure where they are arrayed in another form may be adopted. Furthermore, the touchpads 32 and 34 may have a bowl-like or recessed shape having a curved or spherical surface, or may be structured to have a projecting or recessed curved surface while having a rectangular, trapezoidal or fan-like planar shape.

In the present embodiment, the touchpads 32 and 34 are structured such that the pad board 36 mounted with a capacitive sensor device and the cover member 38 for protecting a surface of the sensor device are laminated, and the cover member 38 is exposed on the back side of the musical instrument body 102.

However, the present invention is not limited thereto. That is, the cover member 38 applied to the touchpads 32 and 34 may be a part of the housing of the musical instrument body 102. Also, the pad board 36 may be structured to be formed of a flexible printed circuit board (FPC board), or be structured to be attached to a surface of the housing of the musical instrument body 102. By any of these structures, an advantageous effect equivalent to that of the above-described embodiment can be achieved.

<Second Embodiment>

Next, a second embodiment of the electronic musical instrument according to the present invention is described. Here, descriptions of sections and methods equivalent to those of the above-described embodiments are simplified.

Figure 11B:
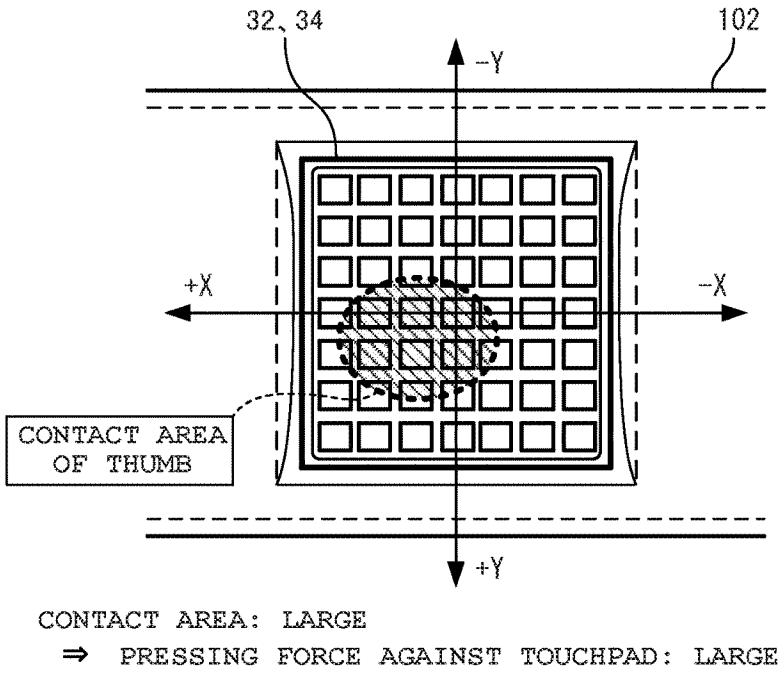
FIG. 11A and FIG. 11B are diagrams showing an example of a touchpad applied to a function operation section of an electronic musical instrument according to a second embodiment.
Figure 11A:
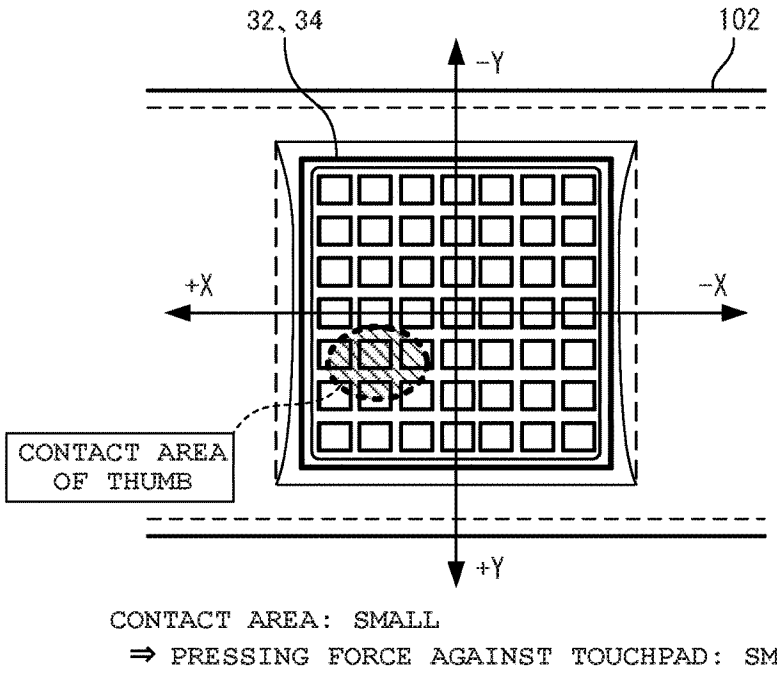
Figure 12:
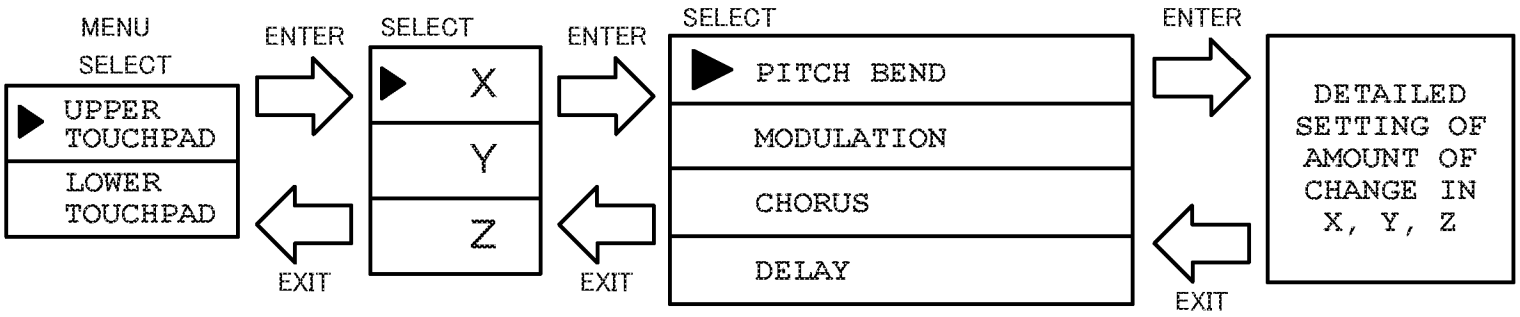
FIG. 12 is a schematic diagram showing an example of a method for setting an effect for the touchpad in a function setting section according to the second embodiment.
Figure 13:
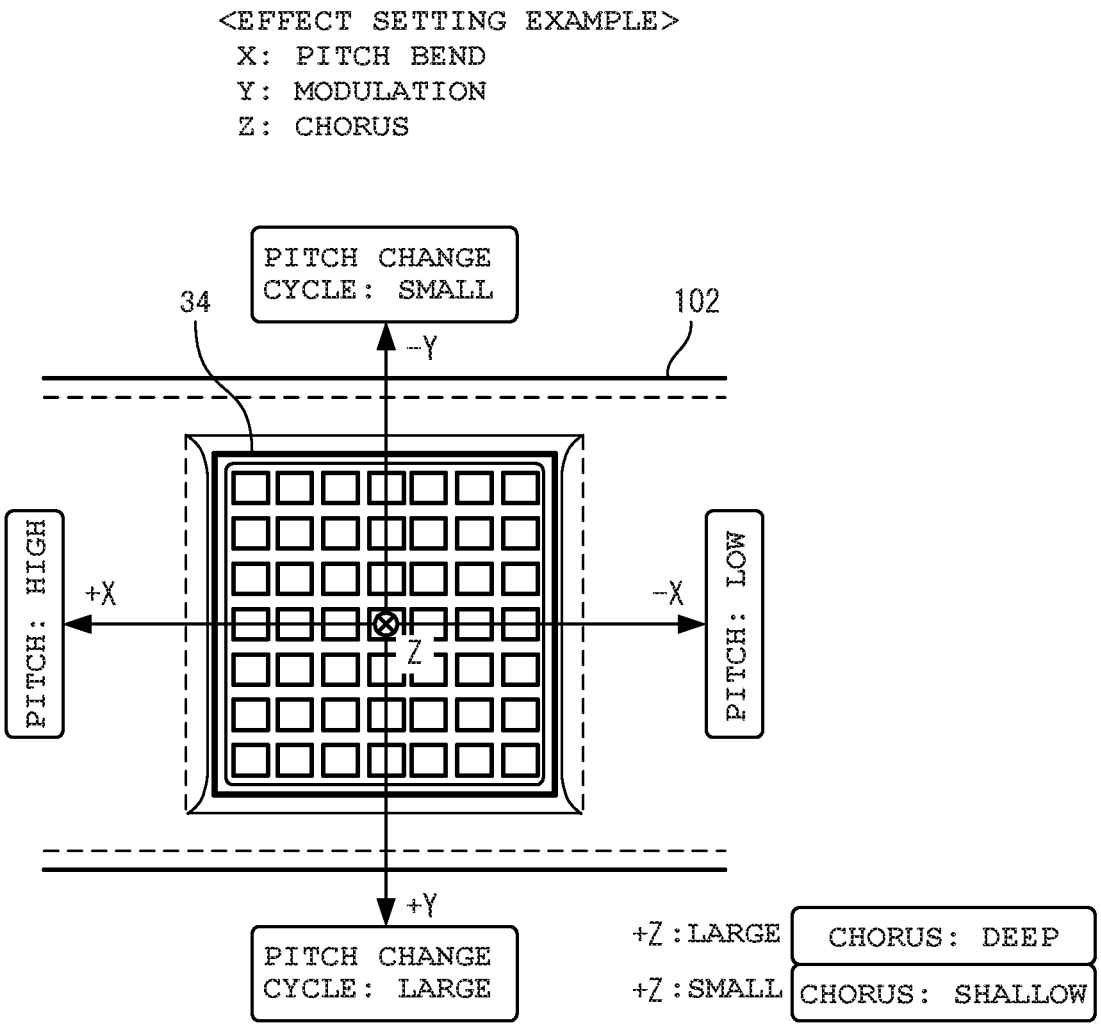
FIG. 13 is a schematic diagram showing an example of an effect set for the touchpad applied to the function operation section according to the second embodiment.

FIG. 11A and FIG. 11B are diagrams showing an example of touchpads applied to a function operation section of the electronic musical instrument according to the second embodiment. FIG. 12 is a schematic diagram showing an example of a method for setting an effect for the touchpads in a function setting section according to the present embodiment. FIG. 13 is a schematic diagram showing an example of an effect set for the touchpads applied to the function operation section according to the present embodiment.

In the first embodiment, the case has been described in which one-dimensional or two-dimensional touchpads are applied as the touchpads 32 and 34 of the function operation section 30. In the second embodiment, a structure and a method are provided in which, as the touchpads 32 and 34, three-dimensional touchpads are applied which detect not only the contact position of each thumb in a two-dimensional plane including X-Y coordinates, but also a pressing force of each thumb which is applied in the Z direction (a specific direction, a third direction) vertical to the plane.

More specifically, in the second embodiment, the contact position of each thumb 202 or 204 is detected as the widening of each contact area within a plane including X-Y coordinates, by use of the two-dimensional touchpads 32 and 34 described in the second example of the first embodiment (refer to FIG. 6). The CPU 50 derives the contact position of each thumb within the X-Y plane of each touchpad 32 or 34 by calculating the centroid of each contact area based on the widening of each contact area. In addition, the CPU 50 derives, based on the areas (dimensions) of the contact areas, the pressing forces of the thumbs 202 and 204 in the Z direction vertical to the touchpads 32 and 34, at the respective contact positions.

The two-dimensional touchpads 32 and 34 generally have properties by which, when the touchpads 32 and 34 are weakly (or lightly) contacted with the thumbs 202 and 204, the contact areas are smaller, and when the touchpads 32 and 34 are strongly pressed with the thumbs 202 and 204, the contact areas are larger, as shown in FIG. 11A and FIG. 11B. Accordingly, in the present embodiment, an algorithm for calculating pressing forces of the thumbs 202 and 204 is used and, based on the contact areas of the thumbs 202 and 204, absolute values of the pressing forces of the thumbs or the relative amount (relative values) of change in the pressing forces thereof are detected. Then, the polarity and intensity of an effect to be given to a musical sound are controlled in accordance with the pressing forces.

In the present embodiment, when an effect is to be set for the upper and lower touchpads 32 and 34, a screen for selection between the upper and lower touchpads 32 and 34 is displayed on the display 42 as shown in FIG. 12 by the MENU key of the setting switch 44 being operated, and a touchpad 32 or 34 where an effect is set is selected by the SELECT key being operated, whereby a screen for selection from among the X-axis, the Y-axis, and the Z-axis of the selected touchpad 32 or 34 is displayed on the display 42. Then, after the X-axis, the Y-axis, or the Z-axis is selected as an axis where an effect is set by the SELECT key being operated, an arbitrary effect is selected from among a plurality of preset effects (such as four effects including PITCH BEND, MODULATION, CHORUS and DELAY) displayed on the display 42, and a set value related to the effect is inputted, as with the above-described embodiment. This series of operations for effect setting is repeated for each axis of the touchpads 32 and 34.

For example, in a case in which, as an effect to be given to a musical sound, PITCH BEND is set for the X-axis of an arbitrary touchpad 32 or 34 (here, 34), MODULATION is set for the Y-axis thereof and CHORUS is set for the Z-axis thereof as shown in FIG. 13 by the above-described method for effect setting, control is performed such that a pitch is bent up when the thumb 204 is moved in the +X direction of the touchpad 34, and a pitch is bent down when the thumb 204 is moved in the −X direction of the touchpad 34. Furthermore, the cycle of change in tone is controlled to be larger (longer) when the thumb 204 is moved in the +Y direction of the touchpad 34, and the cycle of change in tone is controlled to be smaller (shorter) when the thumb 204 is moved in the −Y direction of the touchpad 34. Also, when the thumb 204 is pressed against the touchpad 34 in the +Z direction (a direction from this (front) side of this sheet of paper of FIG. 13 toward the back side thereof), control is performed such that, on the basis of the minimum detection pressure of the touchpad 34, the minimum SEND amount (the amount of reverberating sounds synthesized) is achieved at the minimum detection pressure of the touchpad 34, and the shallowest chorus effect is produced accordingly. In addition, control is performed such that, as the pressing pressure becomes larger (that is, the thumb 204 is pressed more strongly in the +Z direction) with respect to the minimum detection pressure, the SEND amount becomes larger, and a deeper chorus effect is produced accordingly.

As such, in the present embodiment, when the polarity and intensity of an effect are to be controlled during a musical performance, the contact position of the thumb of each hand and the pressing force of each thumb change within a two-dimensional (touchpad) plane in a comparatively narrow range on the back side of the musical instrument body 102, and the positions of the centroids move in accordance with the contact positions of the thumbs 202 and 204 in close contact with the touchpads 32 and 34. Accordingly, it is less likely to cause a change in the positions of a fulcrum and a power point on which the musical instrument body 102 is supported. As a result, while controlling the polarity and intensity of an effect in accordance with the contact positions and the pressing forces of the thumbs 202 and 204, an instrument player can stably support the musical instrument body 102 with these thumbs 202 and 204.

Also, according to the present embodiment, up to three different effects can be arbitrarily set for each of the touchpads 32 and 34, that is, six different effects in total can be arbitrarily set for the touchpads 32 and 34, so that the polarity and intensity of the effects can be simultaneously or individually controlled. As a result, further diverse and rich musical performances and musical sounds caused by the various effects can be achieved by simple operations.

In the present embodiment, an arbitrary effect is set to each of the three axis directions, namely, the X, Y, and Z directions of the three-dimensional touchpads 32 and 34. However, the present invention is not limited thereto. For example, a configuration may be adopted in which an effect is set to only the Y direction and the Z direction on the touchpads 32 and 34, or an effect is set to only the Z direction. By such configuration, the instrument player can arbitrarily use the three-dimensional touchpads 32 and 34 as one-dimensional or two-dimensional touchpads. As a result, the instrument player can use a favorable musical performance method while stably supporting the musical instrument body 102 during a musical performance.

Also, the above-described embodiment is structured such that a plurality of control operations are performed by the CPU (general-purpose processor) executing a program stored in the ROM (memory). However, in the present embodiment, each control operation may be separately performed by a dedicated processor. In this case, each dedicated processor may be constituted by a general-purpose processor (electronic circuit) capable of executing any program and a memory having stored therein a control program tailored to each control, or may be constituted by a dedicated electronic circuit tailored to each control.

Furthermore, the structures of the electronic musical instrument required to exert various effects described above are not limited to the above-described structures, and the following structures may be adopted.

STRUCTURAL EXAMPLE 1

A structure of an electronic musical instrument, including:

a musical instrument body which is supported by first finger of a hand of an instrument player and at least one finger other than the first finger;

scale keys which are provided at positions that are contacted with fingers other than the first finger on one surface of the musical instrument body, and each of which specifies a scale of a musical sound;

a touchpad which is provided in an area that is contacted with the first finger on an other surface of the musical instrument body, and includes a sensor that has a planar detection area for detecting a contact position of the first finger; and a processor which controls emission of the musical sound whose scale has been specified by the scale key in accordance with the contact position of the first finger detected by the touchpad.

STRUCTURAL EXAMPLE 2

The structure of Structural Example 1, in which the scale keys are positioned on an upper side of the musical instrument body during a musical performance, and in which the touchpad is positioned on a lower side of the musical instrument body during the musical performance, and detects an instruction operation performed in a specific direction based on a change in the contact position of the first finger in the planar detection area.

STRUCTURAL EXAMPLE 3

The structure of Structural Example 2, in which the touchpad detects the contact position of the first finger with at least one of a first direction along a longitudinal direction of the musical instrument body and a second direction perpendicular to the first direction as the specific direction.

STRUCTURAL EXAMPLE 4

The structure of Structural Example 3, in which the sensor of the touchpad having the planar detection area has a plurality of electrodes of touch sensors arrayed at least in the second direction along the lower surface of the musical instrument body.

STRUCTURAL EXAMPLE 5

The structure of Structural Example 3, in which the sensor of the touchpad having the planar detection area has a plurality of electrodes of touch sensors arrayed in the first direction and the second direction along the lower surface of the musical instrument body.

STRUCTURAL EXAMPLE 6

The structure of Structural Example 3, in which the touchpad detects a magnitude of a pressing force of the first finger applied in a third direction from the lower side of the musical instrument body toward the upper side thereof, with the third direction as the specific direction.

STRUCTURAL EXAMPLE 7

The structure of Structural Example 2, in which the processor controls to provide a predetermined effect on the musical sound whose scale has been specified by the scale key, in accordance with an operation performed on the touchpad.

STRUCTURAL EXAMPLE 8

The structure of Structural Example 7, in which the processor controls a polarity and an intensity of the effect that is provided on the musical sound, in accordance with the instruction operation performed in the specific direction and detected by the touchpad.

STRUCTURAL EXAMPLE 9

The structure of Structural Example 7, in which the processor simultaneously or individually provides a plurality of different effects on the musical sound, in accordance with instruction operations performed in specific directions and simultaneously or individually detected by the touchpad.

STRUCTURAL EXAMPLE 10

The structure of Structural Example 7, in which the processor simultaneously or individually provides a plurality of different effects on the musical sound, in accordance with instruction operations performed in specific directions by first fingers of hands of the instrument player and simultaneously or individually detected by the touchpad.

STRUCTURAL EXAMPLE 11

The structure of Structural Example 7, further including:

a function setting section which arbitrarily sets effects to be provided on the musical sound, for each of instruction operations that are performed in specific directions and detected by the touchpad.

STRUCTURAL EXAMPLE 12

The structure of Structural Example 1, in which the planar detection area of the touchpad is provided at two positions including a position to be contacted with first finger of right hand of the instrument player and a position to be contacted with first finger of left hand of the instrument player on the other surface.

STRUCTURAL EXAMPLE 13

The structure of Structural Example 1, in which the electronic musical instrument is an electronic wind instrument, and in which the touchpad detects the contact position of the first finger in a lateral direction of the electronic wind instrument.

While the present invention has been described with reference to the preferred embodiments, it is intended that the invention be not limited by any of the details of the description therein but includes all the embodiments which fall within the scope of the appended claims.

What is claimed is:

1. An electronic musical instrument, comprising:

a musical instrument body which is supported by a first finger of a hand of an instrument player and at least one finger other than the first finger;

scale keys which are provided at positions that are contacted with fingers other than the first finger on an upper side of the musical instrument body during a musical performance, and each of which specifies a scale of a musical sound;

a touchpad which is provided in an area that is contacted with the first finger on a lower side of the musical instrument body during the musical performance, and which includes a sensor that has a planar detection area for detecting a contact position of the first finger; and a processor which controls emission of a musical sound whose scale has been specified by a respective one of the scale keys in accordance with the contact position of the first finger detected by the touchpad, wherein the touchpad detects an instruction operation performed in a specific direction based on a change in the contact position of the first finger in the planar detection area, the specific direction including at least one of a first direction along a longitudinal direction of the musical instrument body and a second direction perpendicular to the first direction.

2. The electronic musical instrument according to claim 1, wherein the sensor of the touchpad having the planar detection area has a plurality of electrodes of touch sensors arrayed at least in the second direction along a lower surface of the musical instrument body.

3. The electronic musical instrument according to claim 1, wherein the sensor of the touchpad having the planar detection area has a plurality of electrodes of touch sensors arrayed in the first direction and the second direction along a lower surface of the musical instrument body.

4. The electronic musical instrument according to claim 1, wherein the touchpad detects a magnitude of a pressing force of the first finger applied in a third direction from the lower side of the musical instrument body toward the upper side thereof, the specific direction further including the third direction.

5. An electronic musical instrument, comprising:

a musical instrument body which is supported by a first finger of a hand of an instrument player and at least one finger other than the first finger;

scale keys which are provided at positions that are contacted with fingers other than the first finger on a first surface of the musical instrument body, and each of which specifies a scale of a musical sound;

a touchpad which is provided in an area that is contacted with the first finger on a second surface of the musical instrument body, and which includes a sensor that has a planar detection area for detecting a contact position of the first finger; and a processor which controls emission of a musical sound whose scale has been specified by a respective one of the scale keys in accordance with the contact position of the first finger detected by the touchpad, wherein the processor controls to provide a predetermined effect on the musical sound whose scale has been specified by the respective one of the scale keys, in accordance with an instruction operation detected by the touchpad.

6. The electronic musical instrument according to claim 5, wherein the processor controls a polarity and an intensity of the effect that is provided on the musical sound, in accordance with the instruction operation detected by the touchpad.

7. The electronic musical instrument according to claim 5, wherein the processor simultaneously or individually provides a plurality of different effects on the musical sound, in accordance with instruction operations simultaneously or individually detected by the touchpad.

8. The electronic musical instrument according to claim 5, wherein the processor simultaneously or individually provides a plurality of different effects on the musical sound, in accordance with instruction operations performed by first fingers of hands of the instrument player and simultaneously or individually detected by the touchpad.

9. The electronic musical instrument according to claim 5, further comprising:

a function setting section which arbitrarily sets effects to be provided on the musical sound, for each of instruction operations that are detected by the touchpad.

10. The electronic musical instrument according to claim 1, wherein the planar detection area of the touchpad is provided at two positions including a position to be contacted with a first finger of a right hand of the instrument player and a position to be contacted with a first finger of a left hand of the instrument player on the lower side of the musical instrument body.

11. The electronic musical instrument according to claim 1, wherein the electronic musical instrument is an electronic wind instrument, and wherein the touchpad detects the contact position of the first finger in a lateral direction of the electronic wind instrument.

12. A control method for an electronic musical instrument having a musical instrument body which is supported by a first finger of a hand of an instrument player and at least one finger other than the first finger, the control method comprising:

determining a scale of a musical sound in accordance with an operation on a respective one of scale keys provided at positions that are contacted with fingers other than the first finger on an upper side of the musical instrument body during a musical performance;

detecting a contact position of the first finger in accordance with an operation on a touchpad which is provided in an area that is contacted with the first finger on a lower side of the musical instrument body during the musical performance, and which includes a sensor that has a planar detection area; and controlling emission of the musical sound whose scale has been determined in accordance with the detected contact position of the first finger, wherein the touchpad detects an instruction operation performed in a specific direction based on a change in the contact position of the first finger in the planar detection area, the specific direction including at least one of a first direction along a longitudinal direction of the musical instrument body and a second direction perpendicular to the first direction.

13. The control method according to claim 12, wherein a magnitude of a pressing force of the first finger applied in a third direction from the lower side of the musical instrument body toward the upper side thereof is detected in accordance with the instruction operation on the touchpad, the specific direction further including the third direction.

14. A control method for an electronic musical instrument having a musical instrument body which is supported by a first finger of a hand of an instrument player and at least one finger other than the first finger, the control method comprising:

determining a scale of a musical sound in accordance with an operation on a respective one of scale keys provided at positions that are contacted with fingers other than the first finger on a first surface of the musical instrument body;

detecting a contact position of the first finger in accordance with an operation on a touchpad which is provided in an area that is contacted with the first finger on a second surface of the musical instrument body, and which includes a sensor that has a planar detection area; and controlling emission of the musical sound in accordance with the detected contact position of the first finger, wherein a predetermined effect is controlled to be provided on the musical sound whose scale has been specified by the respective one of the scale keys in accordance with the operation on the touchpad.

* * * * *